US006231162B1

(12) United States Patent
Nikolaevich et al.

(10) Patent No.: US 6,231,162 B1
(45) **Date of Patent: *May 15, 2001**

(54) INK-JET PRINTING METHOD AND AN INK-JET PRINTING HEAD

(76) Inventors: Maximovsky Sergei Nikolaevich, ul. Skakovaya, d. 34, korp. 4, kv. 235; Radutsky Grigory Avramovich, ul. Pervomaiskaya, d. 66, kv.45, both of Moscow, Russian Federation (RU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/945,163

(22) PCT Filed: Nov. 27, 1995

(86) PCT No.: PCT/RU95/00251

§ 371 Date: Oct. 21, 1997

§ 102(e) Date: Oct. 21, 1997

(87) PCT Pub. No.: WO96/33071

PCT Pub. Date: Oct. 24, 1996

(30) Foreign Application Priority Data

Apr. 21, 1995 (RU) ..... 95105713

(51) Int. Cl.[7] ..... B41J 2/14
(52) U.S. Cl. ..... 347/51; 347/55
(58) Field of Search ..... 347/51, 47, 77, 347/10, 63, 65, 69, 52, 55, 57

(56) References Cited

U.S. PATENT DOCUMENTS

| | | | | |
|---|---|---|---|---|
| 4,312,009 | * | 1/1982 | Lange | 347/51 |
| 4,580,148 | | 4/1986 | Domoto et al. | 347/63 |
| 4,829,319 | * | 5/1989 | Chan et al. | 347/47 |
| 4,887,100 | | 12/1989 | Michaelis et al. | 347/69 |
| 4,897,665 | | 1/1990 | Aoki | 347/10 |
| 4,897,674 | | 1/1990 | Hirasawa | 347/94 |
| 5,455,614 | * | 10/1995 | Rhodes | 347/77 |
| 5,713,673 | * | 2/1998 | Nemoto et al. | 347/51 |

FOREIGN PATENT DOCUMENTS 0400955 12/1990 (EP) .

OTHER PUBLICATIONS

"Light–Hydraulic Effect"; Diploma No. 65; A.M. Prokhorov, et al.; Bulletin of Inventions; No. 19, 1969.

* cited by examiner

*Primary Examiner*—N. Le
*Assistant Examiner*—Lamson D. Nguyen
(74) *Attorney, Agent, or Firm*—Ostrolenk, Faber, Gerb & Soffen, LLP

(57) ABSTRACT

A method of ink-jet printing is implemented by focusing a laser light beam on an ink disposed in capillaries of a head and producing shock pulses therein resulting in ejection of drops of said ink onto an information carrier. An ink-jet printing head has a light beam laser having devices for focusing and deflecting the light beam across the nozzles bases for carrying out ejection of ink drops therefrom according to a predetermined program.

8 Claims, 1 Drawing Sheet

INK-JET PRINTING METHOD AND AN INK-JET PRINTING HEAD

FIELD OF INVENTION

This invention pertains to the office equipment, particularly to printing devices. More particularly the invention relates to ink-jet printing methods and printing heads for such printing intended for a contactless application of information on carriers of various types—paper, film, ceramics, plastics, etc.

DESCRIPTION OF PRIOR ART

Known is an ink-jet printing method that comprise steps of positioning of an information carrier opposite to jet nozzles filled with a liquid expendable printing material, and excitation of pressure pulses in these nozzles for a dispensed supply of the printing material onto the information carrier (U.S. Pat. No. 4,410,359). In the known method, a pressure pulse in nozzles is produced owing to a pulse heating of a liquid printing material resulting in producing a vapour in the heating area, rapid expansion of a liquid and ejection of its drop from a nozzle.

A drawback of this method consists in that a source that provides a thermal action effected on an ink is positioned immediately in each nozzle and controlled externally, which makes realisation of this method difficult when there is great a number of nozzles.

For implementation of the known ink-jet printing method, various ink-jet printing heads are used, e.g. such that are described in U.S. Pat. No. 4,508,148, cl. 346/14OR. This patent describes an ink-jet printing head comprising as many resistors for ink heating as there are nozzles therein. Each resistor has a current supply arrangement connecting it to a power supply. For ejection of a drop from a nozzle, the supply circuit of corresponding resistor is closed. When a current pulse flows through a resistor, the latter is heated and heats the ink located in the area where such resistor is disposed to the vaporous state, whereby the liquid, while expanding, creates a shock pulse which ejects a drop thereof through a nozzle. Thereafter, when the liquid is cooled off, the process may be repeated.

A drawback of such heads is their structural complexity, for such head must have as many resistors as there are nozzles positioned at a little spacing and provided with a current supply system; and a low reliability, as the mode of resistor multiple pulse heating to a sufficiently high temperature determines their limited service life.

DISCLOSURE OF THE INVENTION

The basic purpose of the invention consists in providing such method and a head for ink-jet printing that will exclude positioning of a source of shock pulses for ink drops ejection from head nozzles immediately in a head, simplify the head structure and improve reliability and durability of its operation.

The set purpose is to be attained as follows: In an ink-jet printing method comprising steps of positioning an information carrier opposite to jet nozzles filled with a liquid expendable printing material, and excitation of pressure pulses in these nozzles for a dispensed supply of the printing material onto an information carrier, according to the invention a quantum generator (laser) light beam is focused on the liquid printing material disposed on the nozzles so that shock pulses are produced as the light beam is absorbed by this material.

In such method, a source of a shock action effected on an ink is located outside the nozzles or cavities with an ink adjacent to them, which allows to improve quality of printing owing to diminishing of the nozzles diameter and a spacing therebetween, and simplifies possibility of realisation of said source when there is a great number of nozzles.

The set purpose is also attained through in that in an ink-jet printing head comprising a number of nozzles in the form of capillary openings filled with a liquid expendable printing material, and means for producing a pressure pulse in a capillary for a dispensed supply of this material onto an information carrier, according to the invention the means for producing a pressure pulse in a capillary is arranged in the form a light beam laser having a device for focusing said beam to a size smaller then the capillary diameter, and a device for deflecting the beam across nozzle bases from the side that is opposite to an information carrier.

Such arrangement of an ink-jet printing head simplifies its design, because in the head nozzles there are no elements producing the action of a shock action effected on a liquid, and a head itself has no system for supplying current to said elements; reliability of its operation is enhanced owing to simplification of the design and exclusion therefrom of any parts operating in the sharp temperature drop mode.

The nozzle bases are preferably open and nozzles, over the bases level upward, communicate with channels for procuring an expendable printing material for them.

The nozzle bases are also preferably covered with a material which is transparent to a wavelength emitted by a laser.

Such arrangement of a head permits that a laser light beam will act efficiently on an ink disposed in a nozzle and produce shock pulses therein to eject drops thereof onto an information carrier.

BRIEF DESCRIPTION OF DRAWINGS

Hereinafter the invention will be explained by its particular but not limiting embodiments, and accompanied drawings wherein.

BEST MODES FOR CARRYING OUT THE INVENTION

Figure 1:
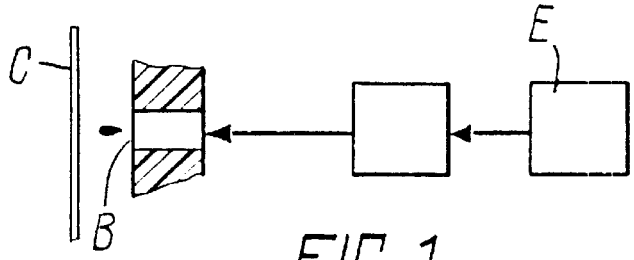
FIG. 1 illustrates the proposed method of the ink-jet printing.

The proposed method of an ink-jet printing is implemented as follows:

An information carrier C (FIG. 1) is positioned opposite to nozzles B filled with a liquid expendable printing material. Thereafter a light beam emitted from laser E is focused on the liquid printing material. In accordance with the discovery named as "Lighthydraulic Effect" (diploma N 65 BI N 19, 1969), when a laser light beam is absorbed within a liquid, a shock pulse (wave) is produced. Energy release is ensured, when the 'Lighthydraulic Effect' takes place, due to a powerful short light pulse.

With this effect a shock pulse is created within nozzle B itself which is filled with a liquid printing material, whereby a drop of the liquid is ejected from the nozzle and hits the information carrier.

From the above-cited description of the proposed method it is obvious that a source that effects a shock action on an ink is located outside the nozzles or cavities with the ink adjacent to them, which allows one to improve quality of printing owing to the provided possibility to diminish the drops diameter and increase density of their positioning on an information carrier.

Figure 2:
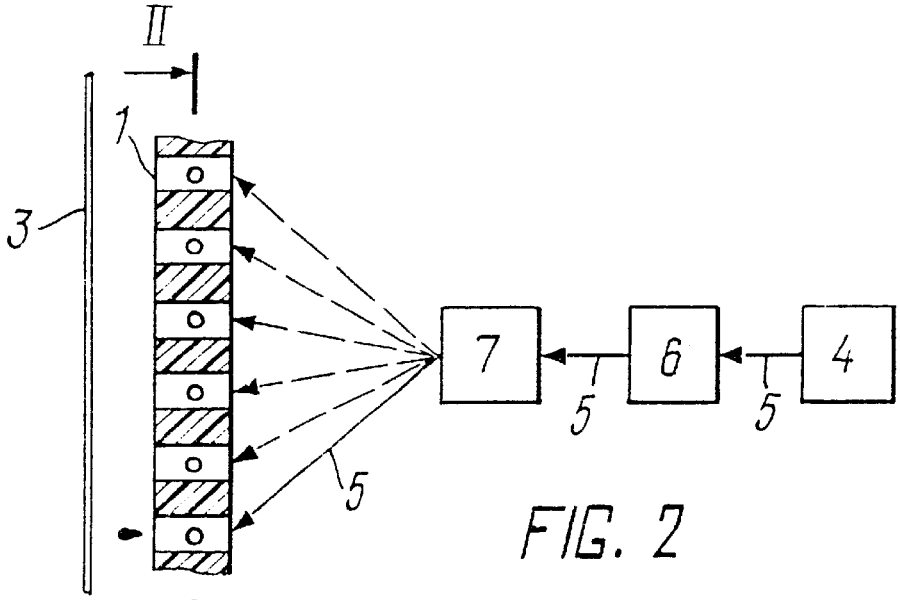
FIG. 2 general view of the proposed ink-jet printing head for embodying an ink-jet printing method with open nozzle bases, FIG. 3 ditto, as FIG. 2 with closed nozzle bases, FIG. 4 section along II—II line of FIG. 2.

For realisation of the proposed ink-jet printing method, it is necessary that a laser light beam sweep will be provided across the bases fo nozzles filled with an ink. This is done by an ink-jet printing head shown in FIG.2

Figure 3:
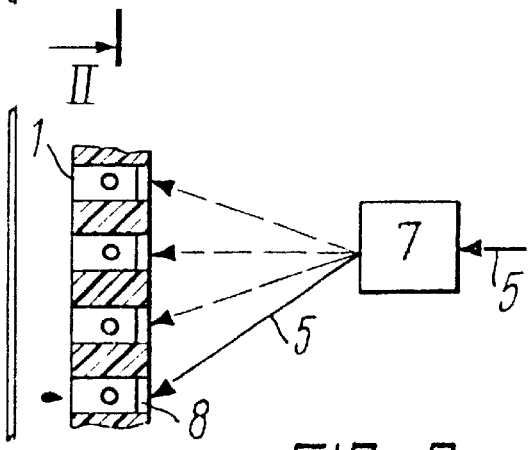
Figure 4:
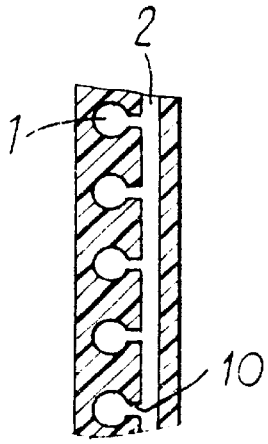

The proposed ink-jet printing head comprises a number of nozzles 1 in the form of capillary openings filled with a liquid expendable printing material supplied into nozzles form channel 2 (FIG.4). Information carrier 3 is positioned perpendicularly to axes of nozzles 1. Opposite ends of nozzles, their bases face laser 4 of light beam 5 having devices for focusing 6 of the beam and deflection 7 thereof across bases of nozzles 1. Nozzles 1 bases are arranged to be either open, or covered by material 8 (FIG. 3) that is transparent to a wavelength emitted by laser 4.

The proposed ink-jet printing head operates as follows:

Beam 5 of laser 4 according to a predetermined program is focused using device 6 and directed using device 7 for its deflection onto a liquid disposed in a given nozzle 1. As light beam 5 is absorbed within the liquid, the lighthydraulic effect is produced whereby in the liquid disposed in a capillary a shock pulse is produced, due to action of which pulse a drop of the ink is ejected form nozzle 1 and hits information carrier 3. Then the action effected beam 5 on the given nozzle 1 is terminated such that the ink for compensation of the ejected drop is supplied to the nozzle form channel 2. By deflecting beam 5 of laser 4 across bases fo nozzles 1 according to a predetermined program, as set of dots representing a text or an image on information carrier 3 can be obtained.

INDUSTRIAL APPLICABILITY

An ink-jet printing head is intended for visual high resolution representation of a textural or graphical information on any type of a carrier.

What is claimed is:

1. A method of ink-jet printing comprising the steps of positioning an information carrier opposite to a jet nozzle comprising a capillary extending from a base to a nozzle opening, said capillary filled with a liquid expendable printing material and imposing a pulse of laser light on the liquid printing material in the capillary sufficient to generate a hydraulic shock wave in the liquid printing material and expel the liquid printing material from the nozzle to the information carrier.

2. The method of ink-jet printing of claim 1 which comprises the step of refilling the capillary with the liquid printing material and repeating the imposing said pulse of laser light on the liquid printing material.

3. The method of ink-jet printing of claim 2 in which the refilling and imposing steps are repeated a plurality of times.

4. A method of ink-jet printing according to claim 3 in which the laser light beam is focussed to a size smaller than a dimension of the capillary transverse to the axis form the base to the opening.

5. An ink-jet printing head comprising a plurality of nozzles each of which comprises a capillary extending from a base to a nozzle opening adapted to be positioned opposite an information carrier, a laser adapted to release pulses of a laser light beam, a focussor adapted to focus the laser light beam to a size smaller than a capillary dimension transverse to the axis from a nozzle base to a nozzle opening and a deflector adapted to deflect the laser light beam to the capillary at the nozzle base.

6. An ink-jet printing head as claimed in claim 5 in which the nozzle base comprises a cover through which the laser light beam can travel.

7. An ink-jet printing head as claimed in claim 6 comprising a supply of liquid expendable printing material for the capillary.

8. An ink-jet printing head as claimed in claim 7 in which the supply comprises a liquid printing material supply channel communicating with an aperture in the capillary.

* * * * *